US006308614B1

(12) United States Patent
Noda

(10) Patent No.: US 6,308,614 B1
(45) Date of Patent: Oct. 30, 2001

(54) ACTUATOR DEVICE

(75) Inventor: Mitsuo Noda, Ichinomiya (JP)

(73) Assignee: Howa Machinery, Ltd., Nagoya (JP)

( * ) Notice: Subject to any disclaimer, the term of this patent is extended or adjusted under 35 U.S.C. 154(b) by 0 days.

(21) Appl. No.: 09/577,873

(22) Filed: May 25, 2000

(30) Foreign Application Priority Data

May 26, 1999 (JP) ..... 11-146222
May 26, 1999 (JP) ..... 11-146223

(51) Int. Cl.[7] ..... F01B 29/00
(52) U.S. Cl. ..... 92/88
(58) Field of Search ..... 92/88; 244/63

(56) References Cited

U.S. PATENT DOCUMENTS 2,200,427 5/1940 Merz ..... 244/63
4,566,738 1/1986 Fasth ..... 308/3
6,092,456 * 7/2000 Noda et al. ..... 92/88

FOREIGN PATENT DOCUMENTS

470088-B1 * 8/1937 (GB) .
51-28793 7/1972 (JP) .
60-172711 9/1985 (JP) .
61-200908 12/1986 (JP) .
8-4995 5/1992 (JP) .
2675720 2/1994 (JP) .
8-261209 10/1996 (JP) .
9-210012 8/1997 (JP) .

* cited by examiner

*Primary Examiner*—F. Daniel Lopez
*Assistant Examiner*—Michael Leslie
(74) *Attorney, Agent, or Firm*—Finnegan, Henderson, Farabow, Garrett & Dunner, L.L.P.

(57) ABSTRACT

An actuator device includes a housing having a bore and an internal moving body movable within the bore in the direction along the center axis of the bore. The housing is composed of two housing members which divide the housing along the center axis. An inner surface which forms a part of the wall of the bore and two slit surfaces on both sides of the inner surface are formed on each of the housing members. When two housing members are coupled to each other by fastening the longitudinal portions of the housing members by end members, two slits extending along the entire length of the housing are defined by the slit surfaces of two housing members. Since the respective housing members have relatively simple cross sectional shapes, the housing members can be easily produced, by an extrusion process or a drawing process, at low cost. Further, since two slits are provided on the housing, an external moving body can be connected to the internal moving body by two driving members. Thus, the external force exerted on the external moving body is distributed to two driving members, whereby the strength of the actuator device is increased.

20 Claims, 16 Drawing Sheets

ACTUATOR DEVICE

BACKGROUND OF THE INVENTION

1. Field of the Invention

The present invention relates to an actuator device having a housing and an internal moving body movable within the housing. More specifically, the present invention relates to an actuator device which transmits the movement of the internal moving body to an external moving body disposed on the outside of the housing by a driving member which couples the internal moving body and the external moving body and extends through a slit formed on the wall of the housing.

2. Description of the Related Art

This type of actuator device is known, for example, as a rodless cylinder and an electric linear actuator. In a rodless cylinder, the housing is formed as a cylinder tube and the internal moving body is formed as a piston driven by pressurized fluid, such as air, supplied to the cylinder tube. In an electric linear actuator, on the other hand, the internal moving body is driven by a feed screw extending through the cylinder tube and driven by an electric motor.

The actuator device such as the rodless cylinder and the electric linear actuator are disclosed in various publications. For example:

(A) Japanese Examined Patent Publication (Kokoku) No. 51-28793 and Japanese Unexamined Utility Model Publication (Kokai) No. 61-200908 disclose rodless cylinders. The rodless cylinders in these publications are provided with a cylinder tube (a cylinder barrel) functioning as a housing. The internal moving body formed as a piston moves within a cylinder chamber (a bore) formed in the cylinder tube along the direction of the axis of the cylinder tube. The movement of the piston is transmitted to an external moving body disposed outside of the cylinder tube by a driving member (a piston yoke) which extends through the slit and couples the external moving body to the internal moving body. The rodless cylinders in the '793 publication and the '908 publication are provided with one cylinder chamber and one slit.

(B) Japanese Unexamined Patent Publication (Kokai) No. 8-261209 discloses a rodless cylinder similar to those in the publications (A). However, the housing (the cylinder tube) is formed as a curved tube. In other words, the central axis of the cylinder tube is not straight but a curved line.

(C) Japanese Unexamined Patent Publication (Kokai) No. 9-210012 and Japanese Patent No. 2675720 disclose rodless cylinders similar to those in the publications (A). However, the rodless cylinders in these publications are provided with a guide rail extending in parallel with the axis of the cylinder tube inorder to guide the external moving body.

(D) U.S. Pat. No. 4,566,738 and Japanese Examined Utility Model Publication (Kokoku) No. 8-4995 disclose electric linear actuators. In these publications, internal moving bodies (runners) are driven by electric motors through feed screws (threaded spindles). Therefore, no pressurized fluid is supplied to the cylinder chamber (the bore). The electric linear actuators in these publications are also provided with one cylinder chamber and one slit through which the driving member extends.

(E) U.S. Pat. No. 2,200,427, Japanese Unexamined Patent Publication (Kokai) No. 60-172711 and U.K. Patent No. 470088 disclose actuating devices having a plurality of cylinder chambers formed in one housing. One internal moving body is disposed in each of cylinder chambers. Further, each of the cylinder chambers is provided with one slit formed in the housing wall and the external moving body is coupled to each of the internal moving bodies by a driving member extending through each slit.

In the actuator devices in the publications (A), (B) and (c), since the internal moving body (the piston) is driven by pressurized fluid, internal pressure is exerted on the wall of the cylinder tube. Further, the slit penetrating the wall of the cylinder tube and communicating with the cylinder chamber (the bore) is provided in this type of the actuator devices. Therefore, the internal pressure exerting on the wall of the cylinder chamber causes a stress concentration in the wall of the housing at the portion opposing the slit. Thus, in this type of the actuating device, it is necessary to increase the thickness of the wall of the housing at the portion opposing the slit. This non-uniform thickness of the wall of the housing makes it difficult to produce the housing by an extrusion process or a drawing process. In addition to that, the shape of the cross section of the housing is such that a large void space which communicates with the outside of the housing through a narrow slit is formed in the housing. This shape of the cross section requires a die having a complicated shape and makes the production of the housing by an extrusion or a drawing process difficult.

Further, the stress concentration and the non-uniformity of the wall thickness requires a complicated calculation of the stress distribution of the wall when designing the housing.

In the actuator device in the publication (B), in order to obtain the housing having a curved center axis, a straight housing must bent in such a manner that the center axis thereof forms a required curve. This bending process is complicated and increases the time and the cost required for manufacturing the housing.

Further, in the actuator devices in the publications (A) to (D), the shape of the cross section of the housing is rather complicated due to the necessity for forming the slit on the wall of the housing. Therefore, even a slight modification of the shape of the cylinder chamber requires a large amount of work in order to achieve desired accuracy in the dimension and the shape of the housing, especially in the modification of the die used for forming the housing. Therefore, time and cost required for developing new products becomes rather large.

Further, since only one slit is provided on the wall of the housing, the internal moving body and the external moving body are coupled by only one driving member in the actuator devices in the publications (A), (B) and (D). Therefore, when a bending moment is exerted on the external moving body, or a external force is exerted on the external moving body in the axial direction (for example, when the external moving body abuts a stopper at its stroke end), the bending moment and the axial force must be born by only one driving member in the actuator device in the publications (A), (B) and (D). Thus, the allowable bending moment and axial force of the actuator device becomes rather small.

In the actuator device in the publication (C), since a separate guide rail is provided, a large bending moment exerted on the external moving body can be born by the guide rail. However, since the guide rail cannot bear the axial force exerted on the external moving body, the allowable axial force of the actuator device in the publication (C) is still small.

In the actuator devices in the publications (E), the external moving body is coupled to the internal moving body by a plurality of driving members. Therefore, in this case, the bending moment and the axial force is distributed to a plurality of driving members and the allowable bending moment and the allowable axial force of the actuator device become larger when compared with the actuator devices in the publications (A) (B) and (D). However, in the actuators in the publications (E), more than one internal moving body must be disposed in the housing. This causes the total cross section area of the internal moving bodies, i.e., the total area receiving the pressure of the working fluid decreases compared with the case where one internal moving body is disposed in the housing of the same size. Therefore, in order to obtain the driving force the same as that of the actuator device having one internal moving body in the housing, a larger housing is required in the actuator device in the publications (E).

SUMMARY OF THE INVENTION

In view of the problems in the related art as set forth above, one of the objects of the present invention is to provide an actuator device in which the housing thereof can be manufactured at a relatively low cost.

Another object of the present invention is to provide an actuator device in which the shape of the cylinder chamber can be easily modified without requiring a large cost.

Further, another object of the present invention is to provide an actuator device which can bear a large bending moment and a large axial force without increasing the size of the housing and without disposing an external guide rail.

One or more of the objects as set forth above are achieved by an actuator device, according to the present invention, comprising a housing having a bore extending along a center axis thereof and at least one slit penetrating the wall of the housing and extending in the direction along the center axis, an internal moving body moving within the bore in the direction along the center axis and a driving member connected to the internal moving body and extending to the outside of the housing through the slit in order to transmit the movement of the internal moving body to the outside of the housing, wherein the housing is formed by combining a plurality of housing members which divide the housing along the center axis.

According to the present invention, since the housing of the actuator device is divided into a plurality of housing members, the shapes of the respective housing members becomes rather simple. In other words, each housing members does not have a void space within it. Therefore, when manufacturing the housing members, for example, by an extrusion or a drawing process, the shape of the die used for the extrusion or the drawing can be largely simplified. Further, since the housing is divided into housing members, stress concentration due to internal pressure does not occur.

BRIEF DESCRIPTION OF THE DRAWINGS

The present invention will be better understood from the description, as set forth hereinafter, with reference to the accompanying drawings in which.

DESCRIPTION OF THE PREFERRED EMBODIMENT

Hereinafter, embodiments of the actuator device according to the present invention will be explained with reference to FIGS. 1 through 21. In the following embodiments, the present invention is applied to a rodless cylinder type pressure fluid driven actuator device. However, the present invention also can be applied to an electric linear actuator type actuator device.

Figure 1:
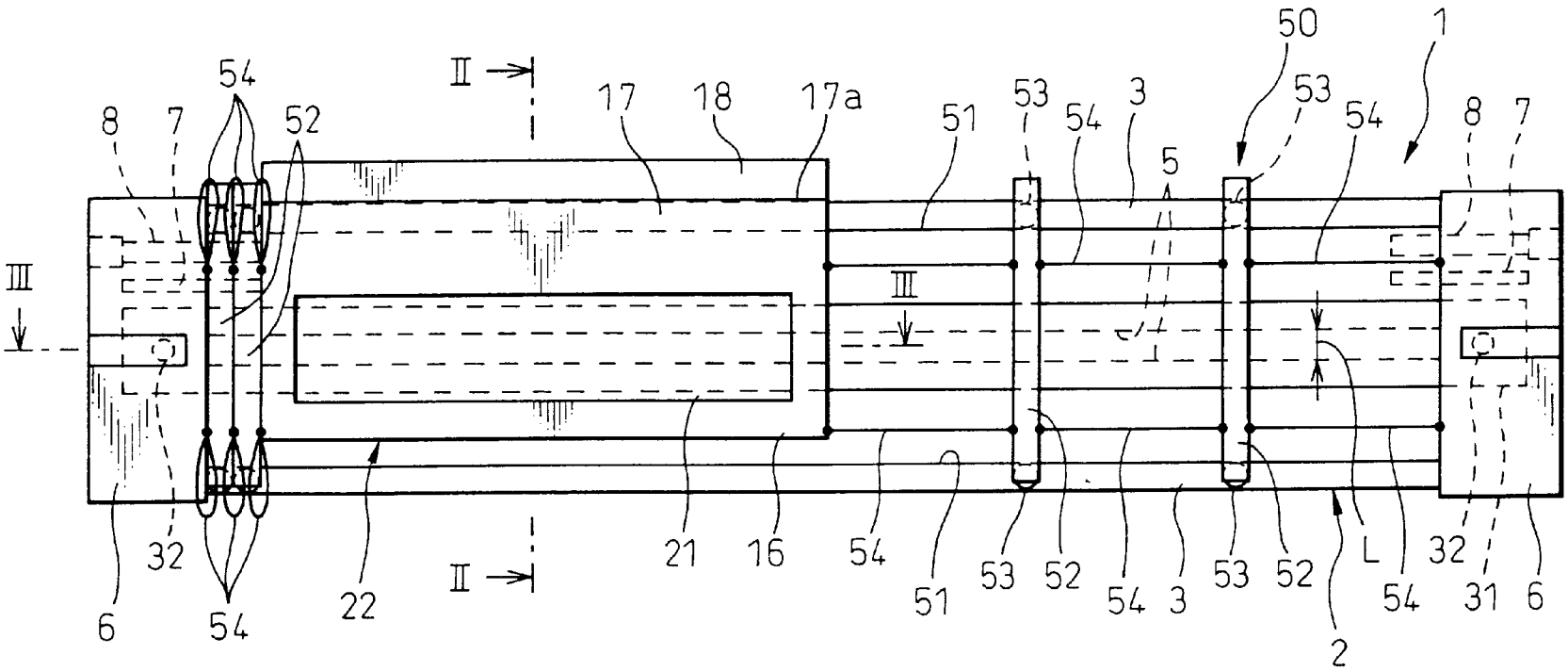
FIG. 1 is a side view of an actuator device according to a first embodiment of the present invention.
Figure 2:
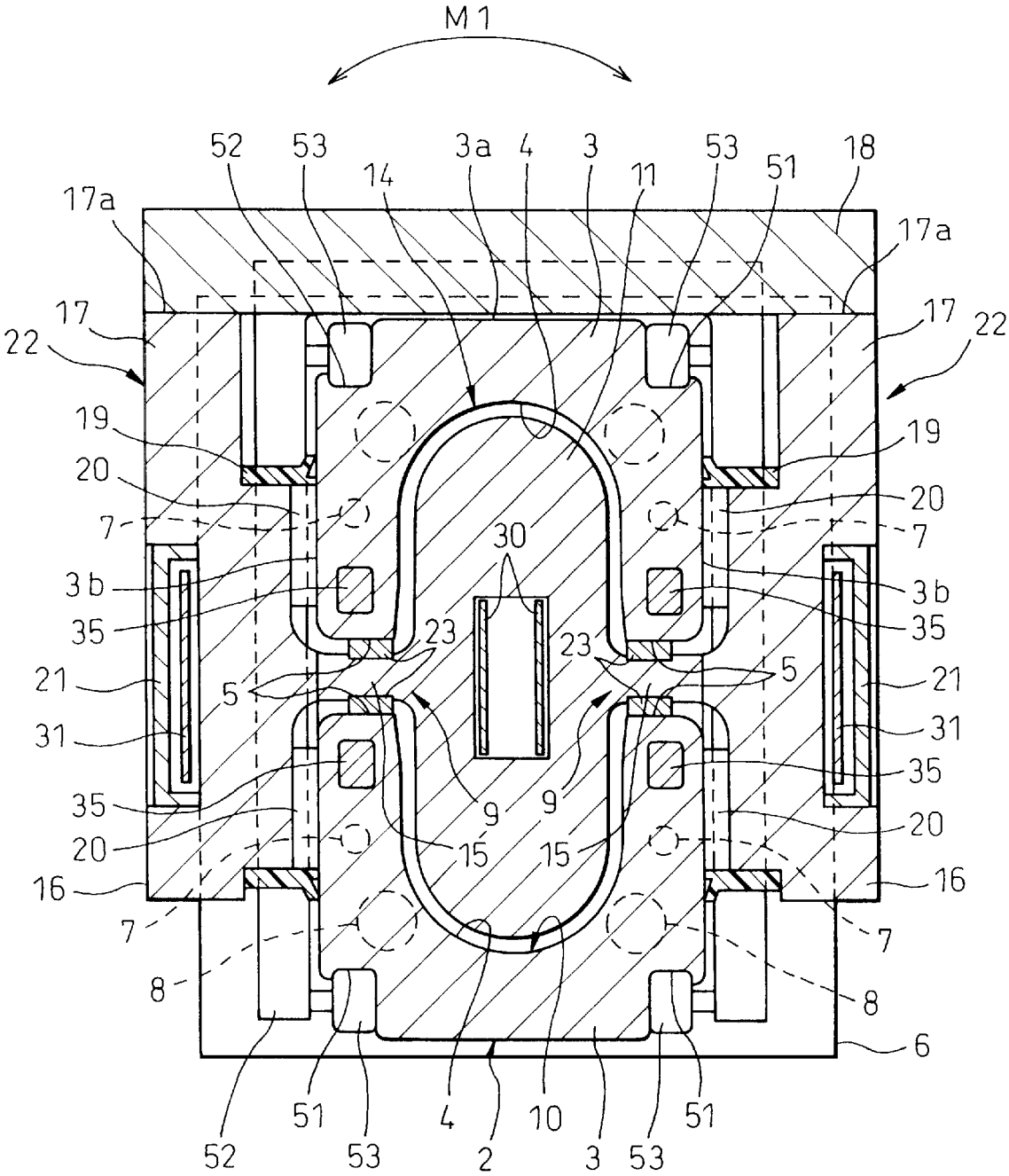
FIG. 2 is an enlarged view of a cross section of the actuator device taken along the line II—II in FIG. 1.
Figure 3:
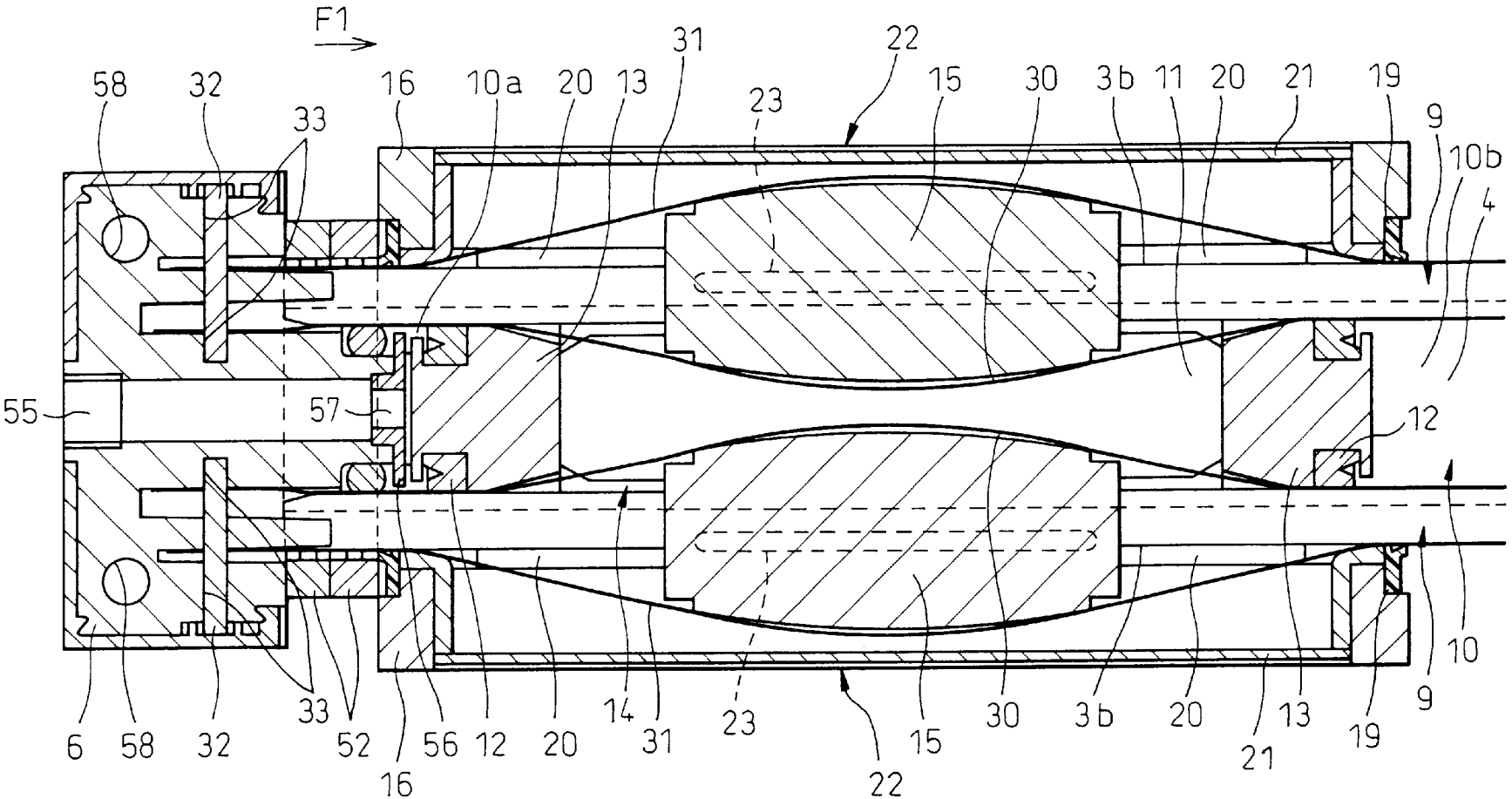
FIG. 3 is an enlarged view of a longitudinal section of the actuator device taken along the line III—III in FIG. 1.
Figure 4:
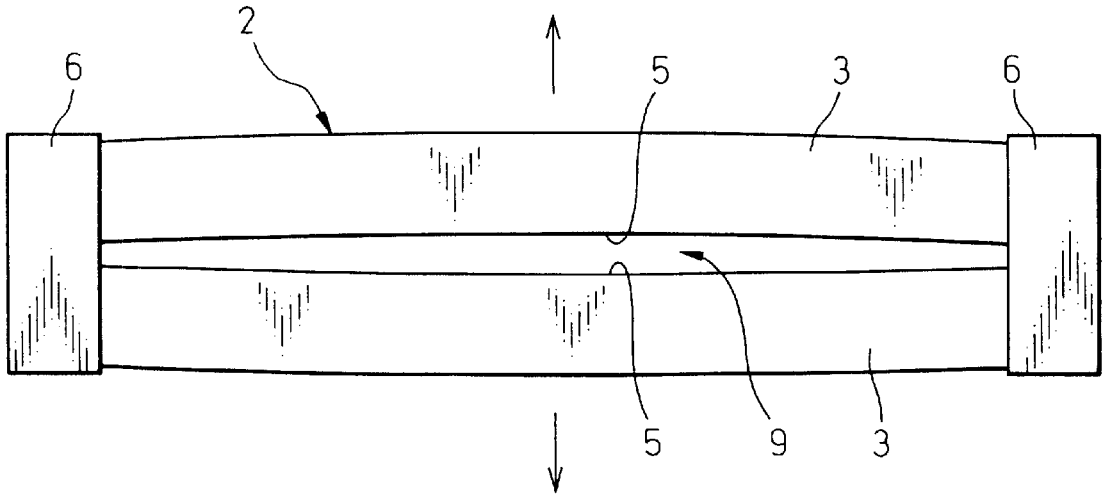
FIG. 4 is a drawing schematically illustrating the deformation of the housing due to the pressure in the cylinder chamber.

FIGS. 1 to 3 shows a rodless cylinder 1 provided with one cylinder chamber and two slits.

As shown in FIG. 2, the rodless cylinder 1 has a housing (a cylinder tube) 2 composed of two separate housing members 3. Housing members 3 have dimensions and cross sectional shapes identical to each other. Each housing member 3 has an inner surface 4 and two slit surfaces 5 disposed on both sides of the inner surface 4. The housing members 3 are coupled to each other by end members 6 by fitting both longitudinal ends of the housing members 3 to the end members 6. When the housing members 3 are coupled to each other by the end members 6, the inner surfaces 4 of the housing members are facing each other and form a inner wall surface of a cylinder chamber. In this condition, a predetermined clearance L is formed between the slit surfaces 5 of both housing members, i.e., two slits 9 having a width L and extending along the entire length of the cylinder tube are formed by the slit surfaces. The housing members 3 are fixed to the end members 6 by tightening fixing screws 8 in the axial direction from the outer faces of the end members 6. Positioning pins 7 are provided in order to secure the clearances L between the slit surfaces 5. As shown in FIG. 2, when the two housing members 3 are coupled, a housing 2 having a cylinder chamber 10 of non-circular (oblong) cross section and slits 9 on the opposite sides thereof is formed.

The housing members 3 are made of aluminum or aluminum alloy and are formed by an extrusion or a drawing process. As can be seen from FIG. 2, since the shape of the cross section of the housing members 3 does not include a large void space communicating to the outside only by a narrow slit, the shape of the die used for an extrusion or a drawing process can be largely simplified. Further, by dividing the housing into two housing members 3, a stress concentration does not occur on the housing wall when the internal fluid pressure is imposed. Therefore, the wall thickness of the housing members can be uniform. This makes the design of the housing easier and, further, makes the production of the housing members by an extrusion or a drawing process much easier. Thus, according to the present embodiment, the housing of the actuator device can be manufactured easily, with lower cost, while maintaining a high accuracy of the dimensions and the shape of the cylinder chamber. Though the cylinder chamber 10 has an oblong cross section in this embodiment, the same advantages of using divided housing members can be obtained when the other cross sectional shapes of the cylinder chamber, such as an ellipse or a circle, are used.

In FIGS. 1 and 3, the cylinder chamber 10 is divided into a fore cylinder chamber 10A and an aft cylinder chamber 10B by piston ends 13 formed on both longitudinal ends of a piston portion 11 (FIG. 2) of the internal moving body 14. Each of the piston ends 13 are provided with a piston packing 12. On the piston portion 11, a pair of driving members (piston yokes) 15 for driving an external moving body 22 are formed integrally on the part of the piston portion 11 opposite to each other. The driving members 15 extending through the slits 3 on the respective sides of the cylinder chamber 10. At the end of each of the driving members 15 outside of the housing 2, a piston mount 16 is integrally formed.

As can be seen from FIGS. 1 and 2, the piston mounts 16 extend along the both side faces of the housing 2, and the upper portions 17 of the piston mounts 16 extend upward (FIG. 2) so that the upper end faces 17*a* thereof extend beyond the upper wall surface 3*a* of the upper housing member 3. A work table 18 extending along the upper wall surface 3*a* of the upper housing member 3 is fixed to the upper end faces 17*a* of both piston mounts 16. Scrapers 19 surrounding the driving members 15 are attached to the inner faces of the piston mounts 16 which facing the outer walls of the housing members 3. The outer faces of the piston mounts 16 are provided with outer seal band covers 21. The piston mounts 16, together with the seal band covers 21, form two external moving bodies 22. A sliding member 23 which contacts and slides on the corresponding slit surface 5 is attached to each of the side faces of the driving member 15.

A pair of seal bands, i.e., an inner seal band 30 and an outer seal band 31 are disposed on the inner wall surface and the outer wall surface of the housing 2, respectively, at each of the slits 9 in such a manner that the inner and outer seal bands close the slit 9 from inside and outside of the housing 2. The inner and outer seal bands 30 and 31 are thin flexible bands made of, for example, a magnetic metal such as steel. The seal bands 30 and 31 have widths wider than the width L of the slits 9. Both ends of the seal bands 30, 31 are fitted to the end members (the end caps) 6 by fitting pins 32 inserted into fitting holes 33 formed on the end members 6. As the seal bands 30, 31, also a known type of synthetic resin band or a laminated composite band made of a synthetic resin band and a steel band can be used.

Magnets 35 are disposed on both sides of the slits 9 along the entire length thereof. Therefore, the seal bands 30 and 31 are attracted to the magnets 35 along the entire length thereof except for the portions thereof passing through the driving members 22. The inner seal bands 30 adhere to and seal the slits 9 by the pressure of the fluid in the cylinder chamber 10 and the attracting force of the magnets 35. The outer seal bands 31 also adhere to and seal the slits 9 by the attracting force of the magnets 35.

As explained above, by using separate housing members 3 in order to form a housing 2, the stress concentration of the wall of the housing is eliminated, and the manufacturing of the housing becomes easier. However, since the housing members 3 are coupled to each other only at their longitudinal ends by the end members 6, it is true that the center portion of the housing members 3 tend to deform in the direction widening the slits 9 due to internal fluid pressure. When the length of the housing, i.e., the stroke of the actuator device, is short, the deformation of the housing members is relatively small and, practically, problems do not occur. However, when the stroke of the actuator device is long, the housing members 3 are likely deform in the manner illustrated in FIG. 4. When such a deformation occurs, the width of the slits 9 becomes larger at the center portion of the housing and deterioration of the seal performance of the seal bands 30 and 31 may occur.

In the embodiment in FIGS. 1 through 3, an anti-deformation device 50 is provided to the housing in order to prevent the deformation of the housing members 3.

As best seen from FIG. 2, the anti-deformation device 50 in this embodiment includes a plurality of C-shaped frames 52 which bestride the upper housing member 3 in FIG. 2. In this embodiment, a pair of guide surfaces 51 extending along the entire length of the housing member are provided on the side faces 3*b* of both housing members 3. The legs of the frames 52 are provided with rollers 53 contacting the respective guide surfaces 3*b* and urging both housing members 3 towards each other in order to prevent the deformation of the housing members 3.

As shown in FIG. 1, two frames 52 are disposed on each portion between the external moving body 22 and the longitudinal ends of the housing members 3 in this embodiment. The external moving body 22 and the adjacent frames 52, the frames 52 and the frames 52 adjacent thereto, as well as the end members 6 and the adjacent frames 52 are connected by flexible cords 54. The length of the flexible cords 54 are set in such a manner that the two frames 52 on one side of the external moving body 22 is disposed at same intervals on the portion between the external moving body 22 and the end member 6 when the external moving body reaches its stroke end as shown in FIG. 1.

When the pressure fluid is supplied to the inlet/outlet port 55 provided on the end members 6, the fluid flows into the cylinder chamber through the port 57 disposed on the internal damper 56, the piston mount 16 moves along the center axis of the housing 2. By this movement of the external moving body 22, the frames 52 ahead the external moving body 22 are pushed by the external moving body 22 and move to the end of the housing members 3 while bending the flexible cords 54. On the other hand, the frames 52 behind the external moving body 22 are pulled by the flexible cord 54 and move toward the external moving body 22. Therefore, the frames 52 are always disposed adequately to clamp the housing members 3 by the rollers 53 regardless of the longitudinal position of the external moving body 22. Thus, even if the stroke of the external moving body 22 is long, the deformation of the housing members 3 and the resulting increase in the width of the slit are effectively prevented. Thus, in this embodiment, deterioration of the seal performance of the seal bands 30 and 31 does not occur.

Since the external moving body 22 are connected to the piston 14 by two driving members (the piston yokes) in this embodiment, the bending moment in the transverse direction (M1 in FIG. 2) and the axial forth (F1 in FIG. 3) exerted on the external moving body 22 can be received by two driving members 15. Therefore, the maximum allowable bending moment and axial force of the actuator device are increased to almost twice of that of the actuator device having only one driving member. Further, although two driving members 15 and slits 9 are provided, both driving members 15 are connected to one piston 14. Therefore, the cross sectional area for receiving the fluid pressure is not decreased. Therefore, it will be understood that, in the present embodiment, the maximum allowable values of the bending moment and the axial force are increased without decreasing the driving force of the actuator device.

Hereinafter, other embodiments of the present invention will be explained with reference to FIGS. 5 to 21. In FIGS. 5 through 21, reference numerals the same as those in FIGS. 1 to 4 designate similar elements unless it is specifically noted otherwise.

Figure 5:
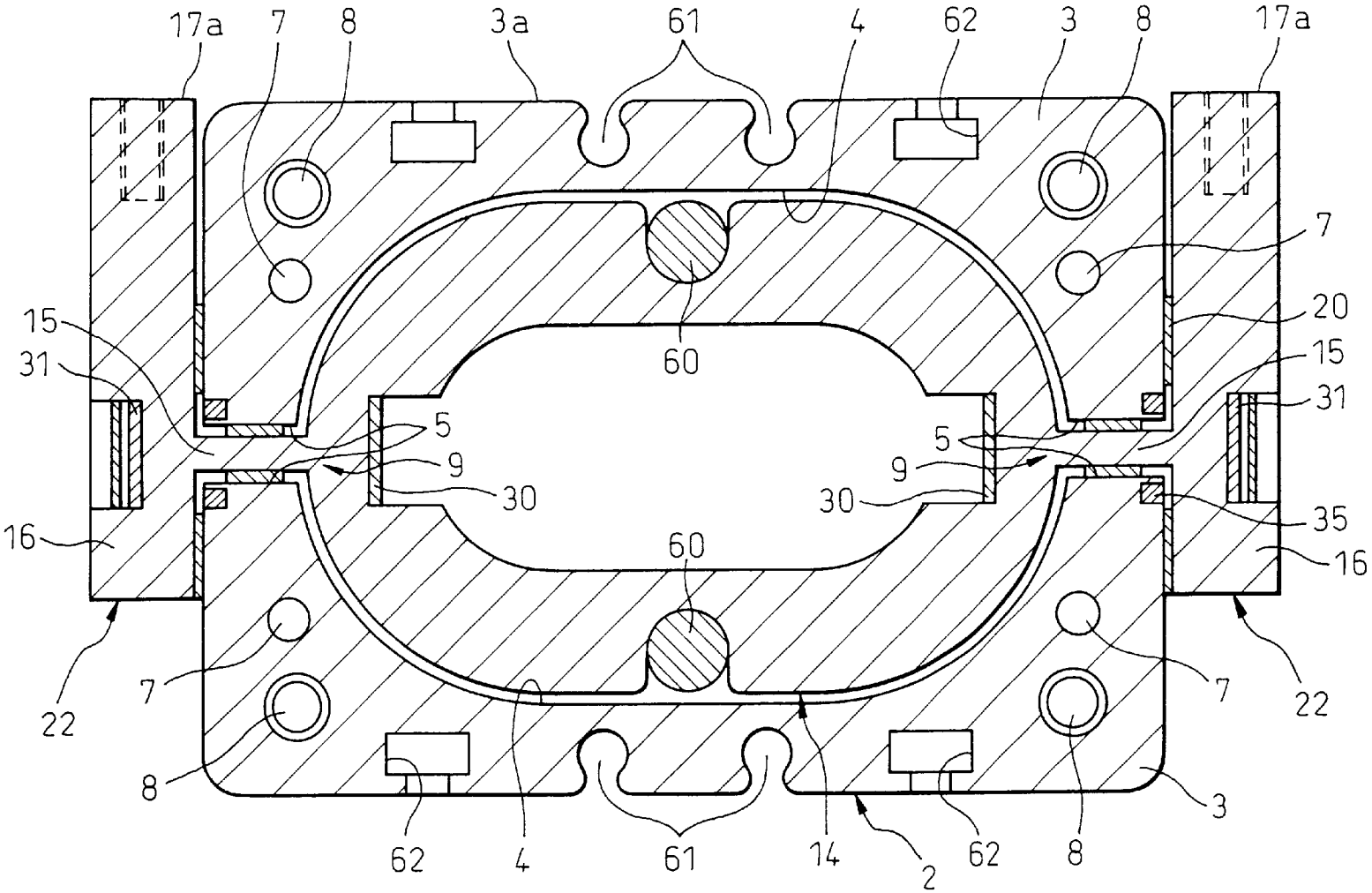
FIG. 5 is a cross sectional view similar to FIG. 2, but of an actuator device according to a second embodiment of the present invention.

FIG. 5 shows a second embodiment of the present invention. Though the slits 9 in the previous embodiment are disposed on both sides of the major axis of the oblong cross section of the cylinder chamber 10 (FIG. 2), the slits 9 in this embodiment are disposed on both sides of the minor axis of the oblong cross section of the cylinder chamber. Since the stroke of the external moving body 22 is rather short, the anti-deformation device 50 (FIG. 2) is not required in this embodiment.

In this embodiment, permanent magnets 60 used for determining the position of the internal moving body 22 are embedded in the piston 14 on both sides of the major axis of the oblong cross section thereof. Sensor grooves 61 for fitting position sensors (not shown) which detect the magnetic field of the permanent magnets 60 are formed on the outer wall of the housing members 3 along the entire length thereof. Further, T-shaped grooves 62 for fixing the actuator to a structure are also formed on the outer walls of the housing members 3.

Figure 6:
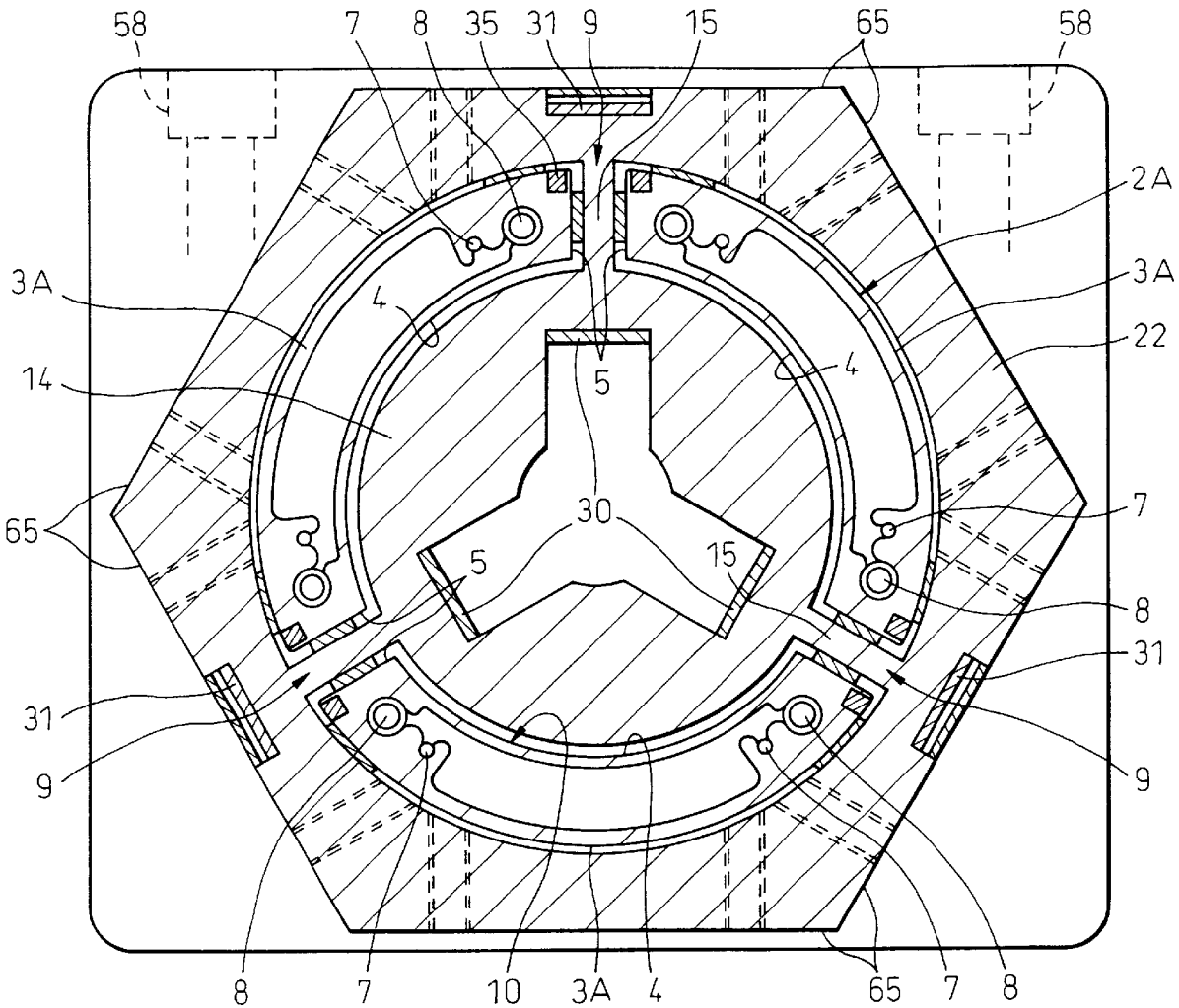
FIG. 6 is a cross sectional view similar to FIG. 2, but of an actuator device according to a third embodiment of the present invention.

FIG. 6 shows a third embodiment of the present invention in which three slits 9 are provided on the housing 2A. In this embodiment, three housing members 3A having identical shapes compose the housing 2A. Each housing member 3A has an inner surface 4 and slit surfaces 5 disposed on both sides of the inner surface 4. The housing members 3A are coupled to each other by the end members 6A. The widths of the slits 9 are secured by the positioning pins 7 and the fixing screws 8 in the same manner as the previous embodiments. When the housing members 3A are coupled to each other, a cylinder chamber 10 having a circular cross section is formed. The slits 9 extend in the radial direction from the cylinder chamber 10 and, through each slit 9, the driving members 15 extends in the radial direction from the piston 14. An annular external moving body 22 surrounding the housing 2A is connected to the driving members 15. On the annular external moving body 22, six outer planar faces 65, each serving as a table for transporting works are formed. Also in this embodiment, inner seal bands 30 and the outer seal bands 31 are provided on the respective slits 9.

Figure 7:
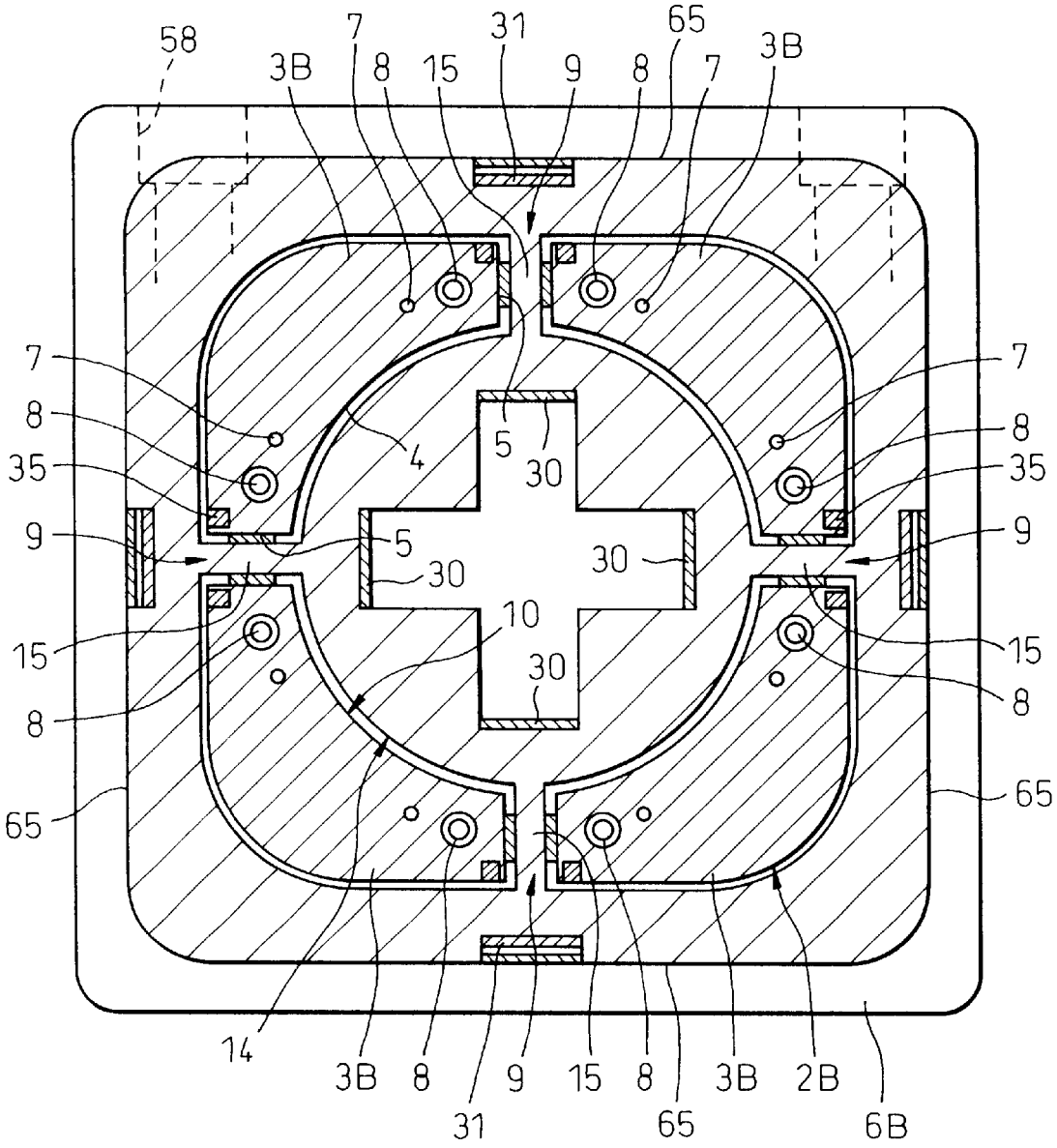
FIG. 7 is a cross sectional view similar to FIG. 2, but of an actuator device according to a fourth embodiment of the present invention.

FIG. 7 shows a fourth embodiment of the present invention in which four slits 9 are provided on the housing 2B. In this embodiment, the housing 2B is divided into four identical housing members 3B each having a quadrant cross section. Each housing member 3B has an inner surface 4 and two slit surfaces 9. When the housing members 3B are coupled to each other by the end members 6B, a housing 2B having a circular cylinder chamber 10 and four radial slits 9 extending from the cylinder chamber is formed. Four driving members 15 extend from the circular piston 14 in the radial direction through the slits 9 and connected to an annular external moving body 22. The annular external moving body also provided with tables 65 for works.

Figure 8A:
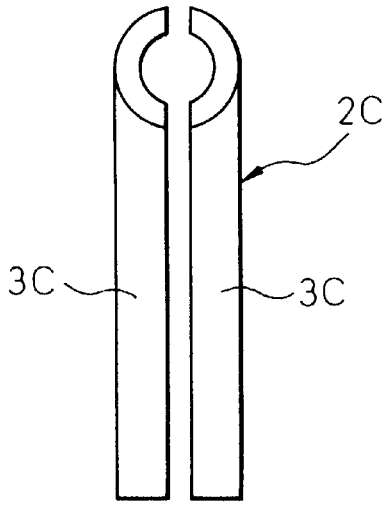
FIGS. 8(A) and 8(B) show a housing having a curved center axis which is used in a fifth embodiment of the present invention.
Figure 8B:
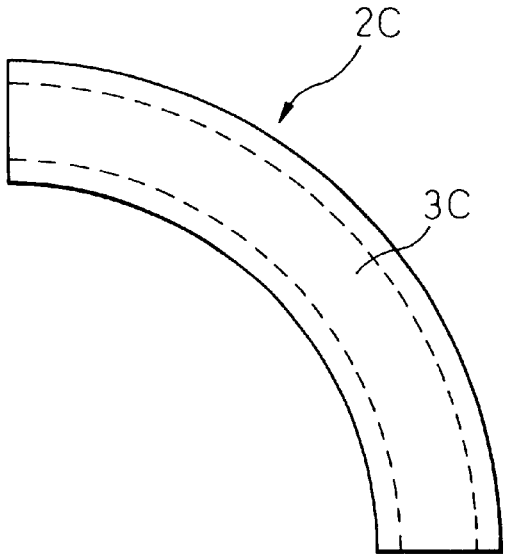

FIGS. 8(A) and 8(B) show a housing 2C of a fifth embodiment. As can be seen from FIG. 8(B), the housing 2C in this embodiment has a curved center axis. When the housing is not straight, dividing the housing 2C into two housing members 3C is especially advantageous. When the housing 2C is divided into two housing members 3C by a plane including the curved center axis of the housing, as shown in FIG. 8(A), the two housing members 3C become identical in shape. In this case, the respective housing members 3*c* can be formed, for example, by a die-casting process using the same die. Therefore, even if the housing 2*c* having a curved center axis is required, the housing 2C can be formed in a simple process without the need for a complicated manufacturing process such as the bending of the straight housing.

Figure 9:
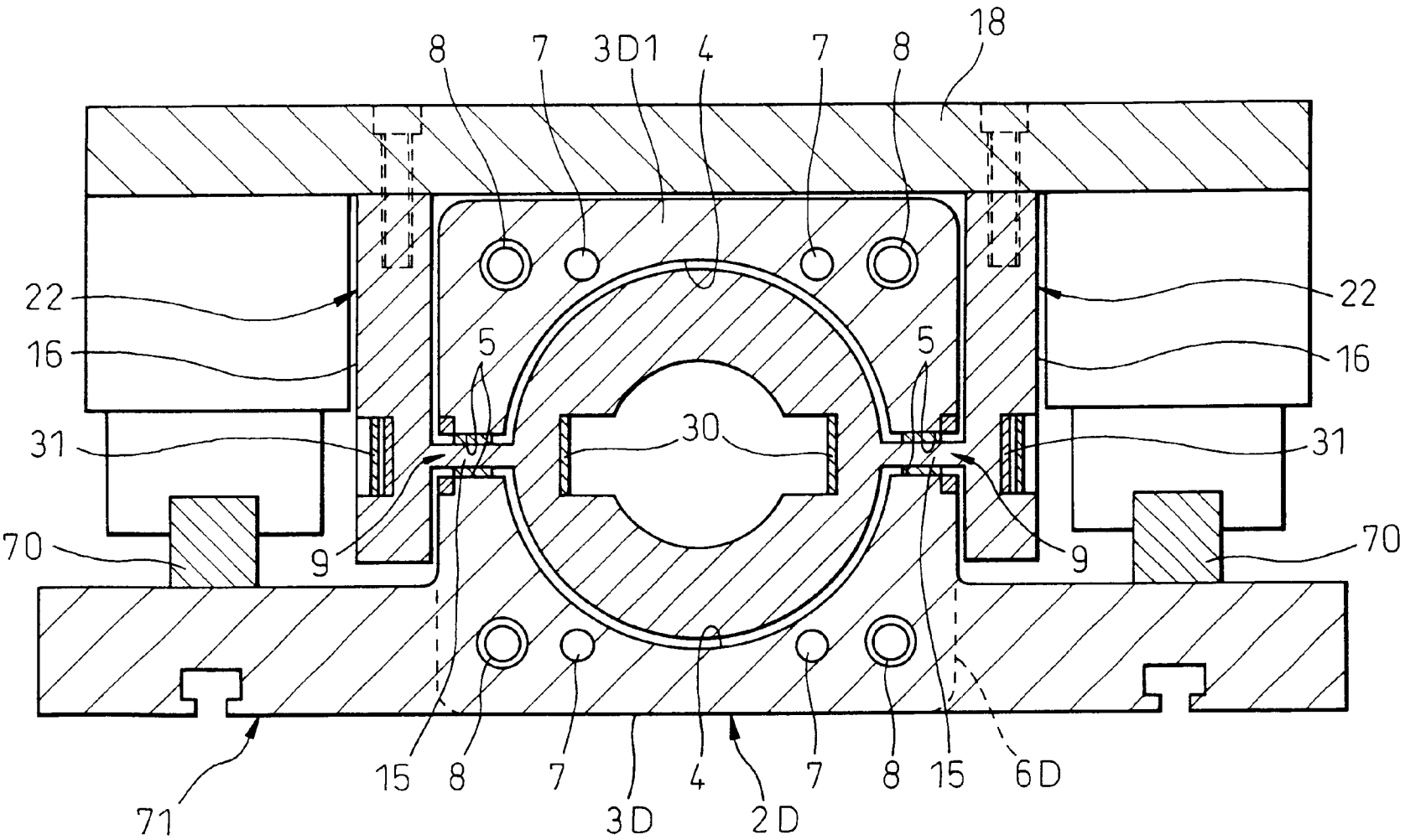
FIG. 9 shows an actuator device according to a sixth embodiment of the present invention which is provided with two external guide rails.

FIG. 9 shows a sixth embodiment of the present invention in which the external moving body 22 is guided by two guide rails 70 disposed separately from the housing 2D. In this embodiment, the housing 2D is composed of a lower housing member 3D and an upper housing member 3D1. A base plate 71 is formed as a part integral with the lower housing member 3D and extends from the lower portion of the housing member 3D to both sides. The slits 9 formed between the two housing members 3D and 3D1 are disposed on the plane parallel to the base plate 71. The housing members 3D and 3D1 are coupled by the end members 6D in the same manner as the previous embodiments. Two driving members 15 extend through the respective slits 9 in the horizontal direction in FIG. 9 and form two piston mounts 16 at the portions outside of the housing 2D. The piston mounts 16 are connected to the lower face of a slide table 18. The slide table 18 is guided by two guide rails (linear guides) 70 on the base plate 71. In this arrangement, the transverse bending moment exerting on the slide table 18 is received by the guide rails 70 and the axial force exerting on the slide table is received by two driving members 15. Thus, according to this embodiment, the allowable bending moment and the axial forces are also increased.

Figure 10:
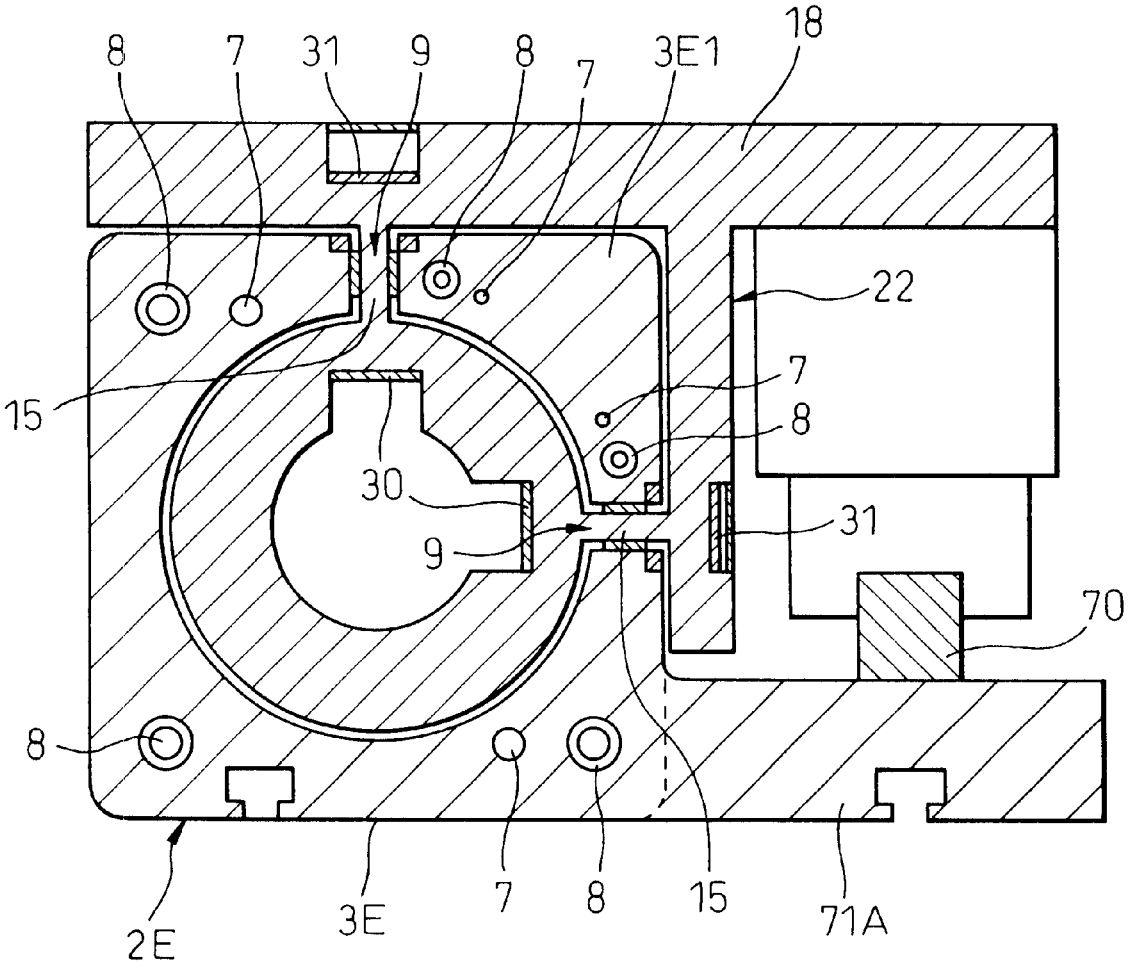
FIG. 10 shows an actuator device according to a seventh embodiment of the present invention which is provided with a single external guide rail.

FIG. 10 shows a seventh embodiment of the present invention in which one guide rail 70 and two slits 9 are provided. In this embodiment, the housing 2E is also divided into to two housing members 3E and 3E1. However, the housing members 3E and 3E1 are formed in different shapes. The housing member 3E1 is formed as a quadrant of a cylinder while the housing member 3E is formed as the shape of the rest of the cylinder. Therefore, in this case, two slits 9 formed by coupling the housing members 3E and 3E1 extend to the directions perpendicular to each other. More specifically, in this embodiment, one slit extends vertically upward and the other slit extends horizontally. The driving members 15 extending through the respective slits 9 join a slide table 18. The slide table 18 is guided by a single guide rail 70 disposed on the base plate 71A extending from the housing member 3E.

Figure 11:
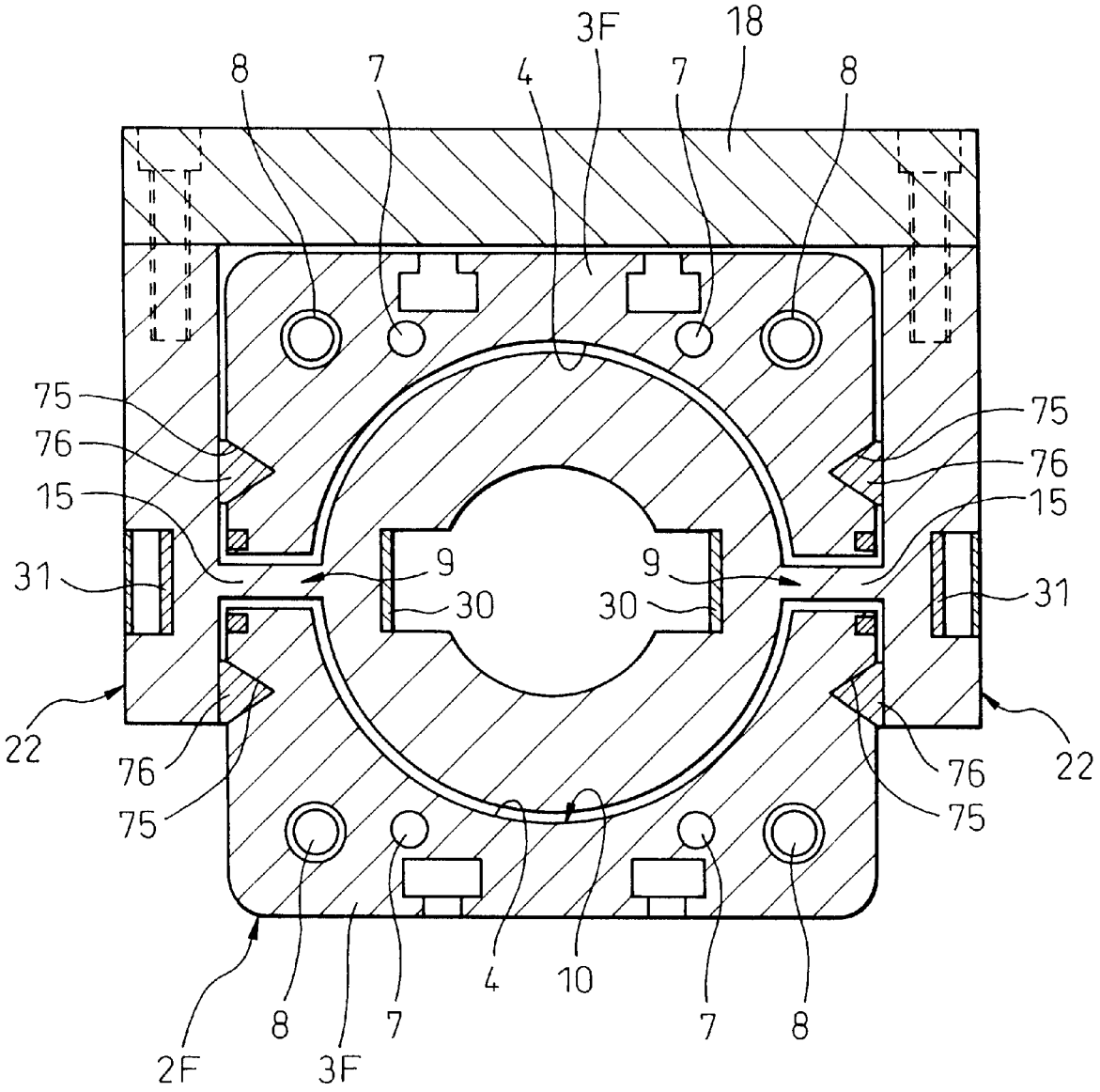
FIG. 11 shows an actuator device according to an eighth embodiment of the present invention in which the device for the housing.

FIG. 11 shows an eighth embodiment of the present invention in which the external moving body 22 also serves as an anti-deformation device of the housing members 3F. In this embodiment, the housing 2F is divided into two identical housing members 3F. Therefore, in this embodiment, two slits 9 are formed on the housing 2F at the opposite side faces thereof. In this embodiment, as shown in FIG. 11, two V-shaped grooves 75 extending in parallel with the slits 9 are formed on the side faces on both sides of each of the slits 9. Further, the external moving body 22 is provided with projections 76 fitting into the respective V-shaped grooves 75 and slide therein with the movement of the external moving body 22. Therefore, the force exerting on the housing members in the direction expanding the widths of the slits 9 are received by the engagements between the V-shaped grooves 75 and the projections 76.

Figure 12:
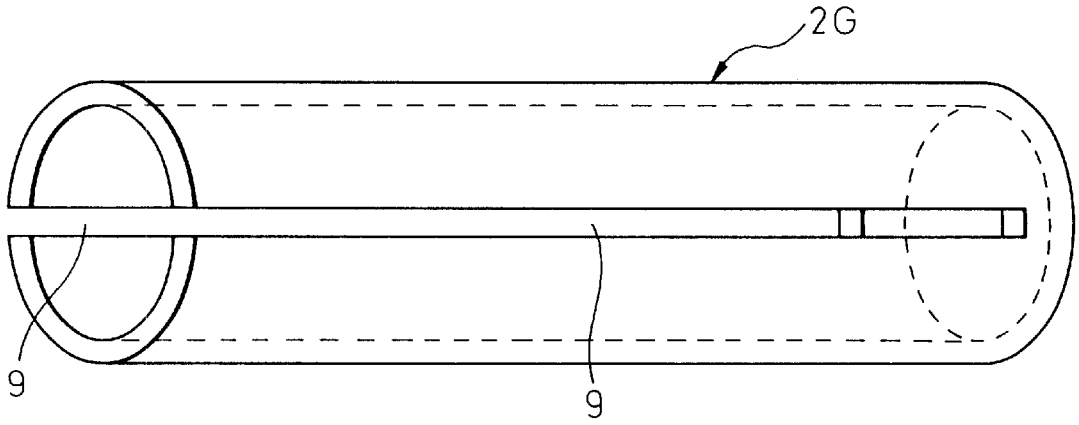
FIG. 12 shows another example of the housing having a plurality of slits.

As explained above, in the embodiments explained in FIGS. 1 through 11, the allowable bending moment and axial force are increased by providing a plurality of slits on the housing wall. Though the embodiments in FIGS. 1 through 11 illustrate the case where the housing of the actuator device is divided into a plurality of separate housing members in order to form a plurality of slits on the housing, a plurality of slits can be formed on the housing without dividing the housing into separate housing members. FIG. 12 illustrates other embodiment of the housing of the actuator device in which a plurality of slits are formed on the housing wall without using separate housing members. As can be seen from FIG. 12, the housing 2G in this embodiment is formed a cylindrical tube of one-piece construction. On the wall of the tube 2G, two slits 9 are formed at the positions opposite to each other. The slits 9 are formed by a cutting the wall of the cylinder tube, however, the slits 9 do not extend along the entire length of the tube 12. Namely, at the one end of the slit, the wall of the tube is not cut off in order to prevent the each half of the cylinder tube formed by cutting the slits 9 from being separated. Thus, the cylinder tube 12 maintains its one-piece construction even after the slits 9 are formed. According to this embodiment, since a plurality of slits can be formed without using separate housing members, the fabrication and assembly of the actuator device can be simplified.

Next, other embodiments of the present invention will be explained with reference to FIGS. 13 through 21. In the embodiments explained in FIGS. 1 through 11, the manufacturing process of the housing of the actuator device is largely simplified by dividing the housing into a plurality of housing members. Though the embodiments in FIGS. 1 through 11 forms more than one slit on the housing wall by using separate housing members, the separate housing members can be used in the case where the housing is provided with only one slit.

In the embodiments explained hereinafter, the housing having only one slit is formed using a plurality of separate housing members. It will be understood that the same advantages of using separate housing members, i.e., the simple manufacturing process, can be obtained even if only one slit is formed on the housing.

Figure 13:
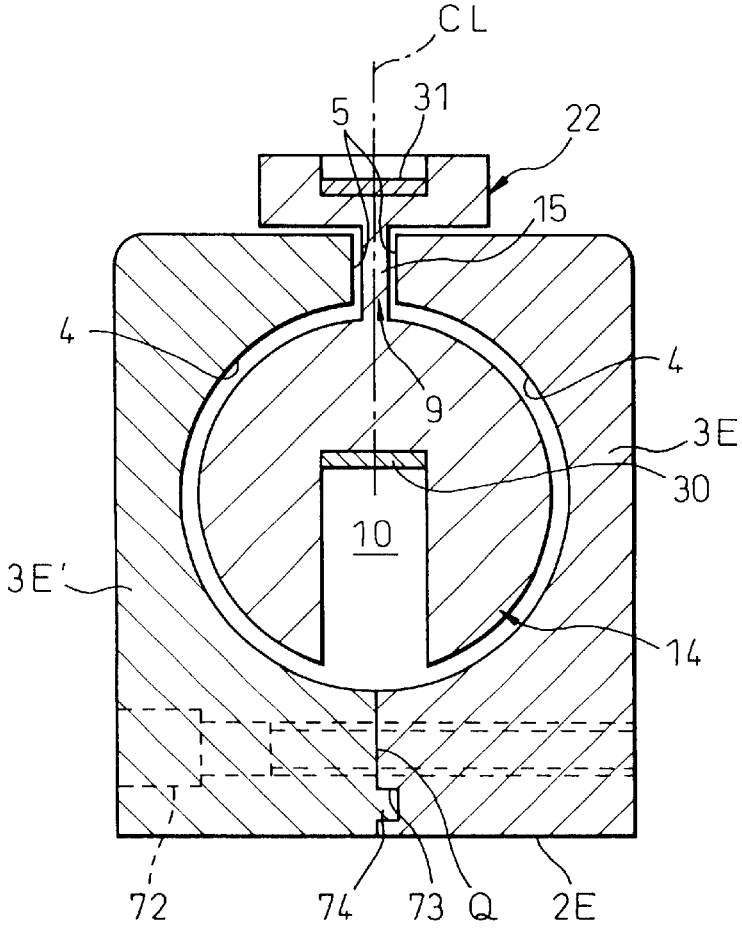
FIGS. 13 through 21 are cross sectional views of various embodiments of the present invention in which the housing is provided with one slit.

In FIG. 13, the housing 2E of the actuator device is divided into two housing members 3E and 3E' by a plane CL passing through the center axis of the housing. The housing member 3E has an inner surface 4 which forms the inner wall surface of the cylinder chamber 10 after the housing members 3E and 3E' are coupled, and a slit surface 9 on one side of the inner surface. In this embodiment, a coupling surface Q is formed on the housing member 3E on the other side of the inner surface 4. Further, a rectangular cross section groove 73 extending in parallel with the center axis of the housing is formed on the coupling surface Q of the housing member 3E. The other housing member 3E' has a shape generally the same as the shape of the housing member 3E. However, instead of the groove 73, a longitudinal projection 74 extending in parallel with the center axis of the housing and having a cross section complimentary to the cross section of the groove 73 is formed on the coupling surface Q of the housing member 3E'. The housing members 3E and 3E' are coupled to each other by fitting the longitudinal projection 74 into the groove 73 and tightening the fixing bolts 72 in the direction perpendicular to the coupling surface Q. The relative position of the housing members 3E and 3E' is determined by the engagement of the projection 74 and the groove 73. An adhesive or liquid sealant is applied to the coupling surfaces Q before the housing members 3E, and 3E' are coupled. When the housing members 3E and 3E' are coupled, a housing 2E having a cylinder chamber 10 and a slit 9 is formed.

Figure 14:
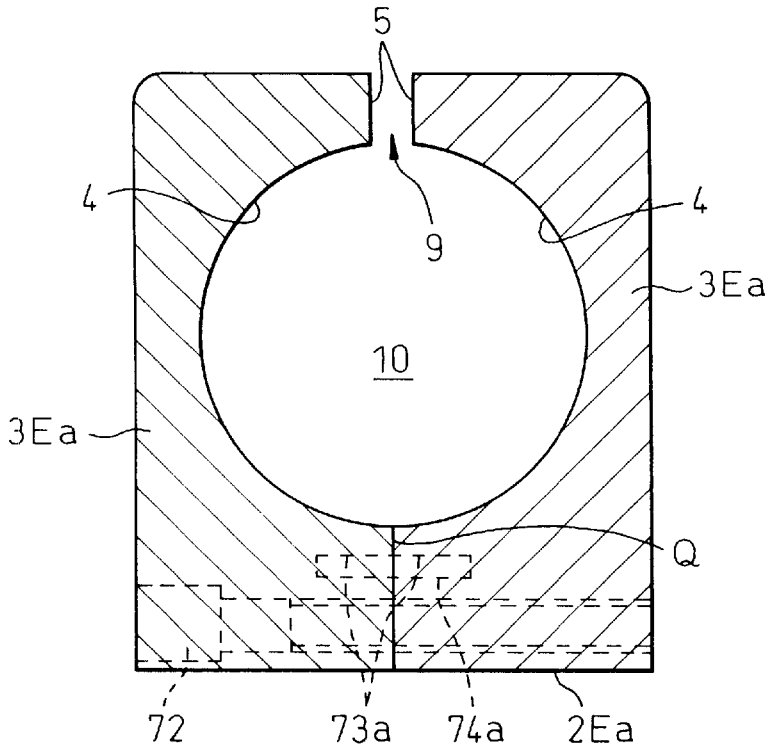

FIG. 14 shows the construction of the housing similar to that in FIG. 13. In this embodiment, the housing 2Ea is divided into two housing members 3Ea in the manner the same as that in FIG. 13. However, the positioning of the housing members 3Ea relative to each other is achieved by the pin holes 73*a* formed on the coupling surfaces Q of the housing members 3Ea at a predetermined interval and positioning pins 74*a* fitted into the pin holes 73*a*.

Figure 15:
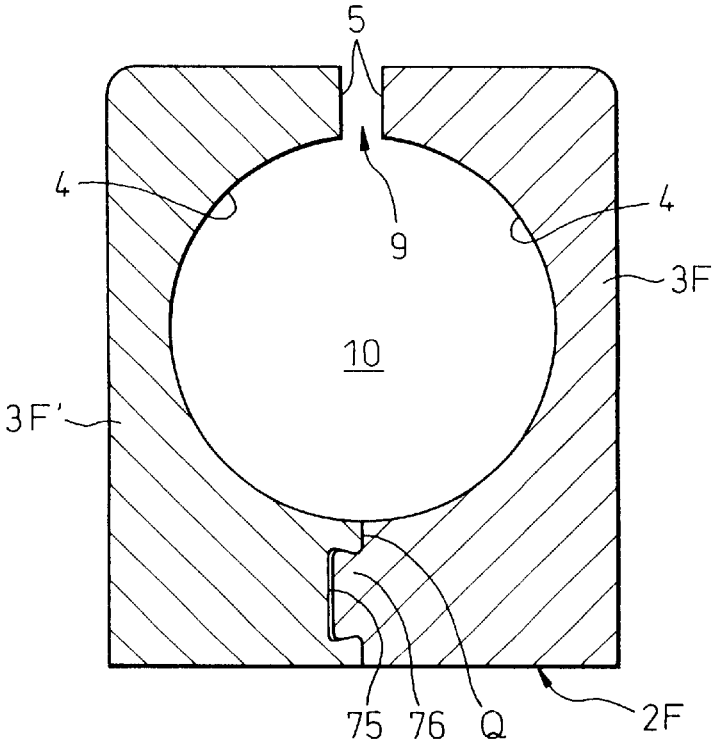

FIG. 15 also shows the housing 2F having a construction similar to those in FIGS. 13 and 14. However, in this embodiment, fitting bolts 72 are not used. The housing members 3F and 3F' of the housing 2F are joined by a dovetail. In FIG. 15, a fan-shaped tenon 76 is formed on the coupling surface Q of one of the housing member 3F and a mortise 75 corresponding the tenon is formed on the coupling surface Q of the other housing member 3F'. The housing members 3F and 3F' are firmly coupled by fitting the tenon 76 into the mortise 75.

Figure 16:
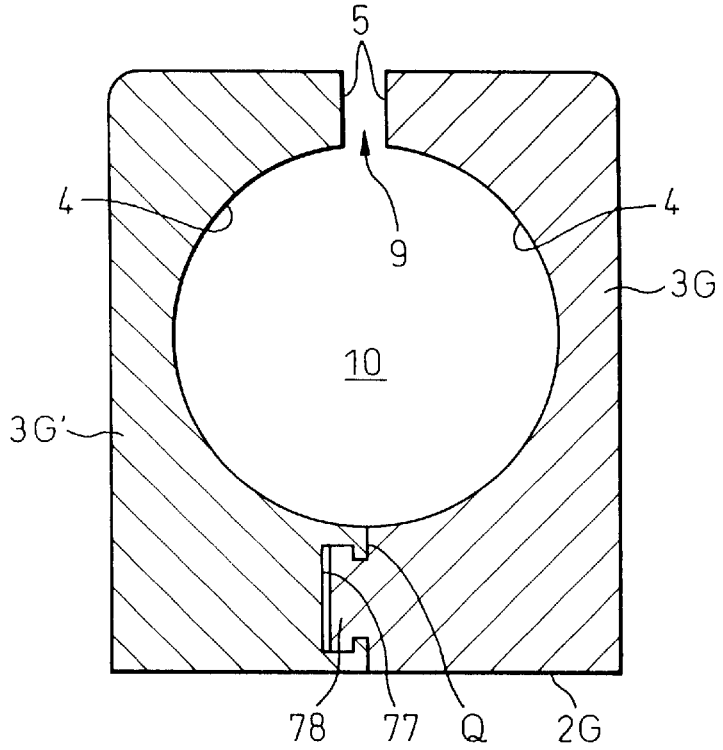

In FIG. 16, T-shaped groove 77 and T-shaped projection 78 are used in lieu of the dovetail in FIG. 15. In this case, the housing members 3G and 3G' are firmly coupled to each other and a housing 2G is formed by fitting the projection 78 into the groove 77.

Figure 17:
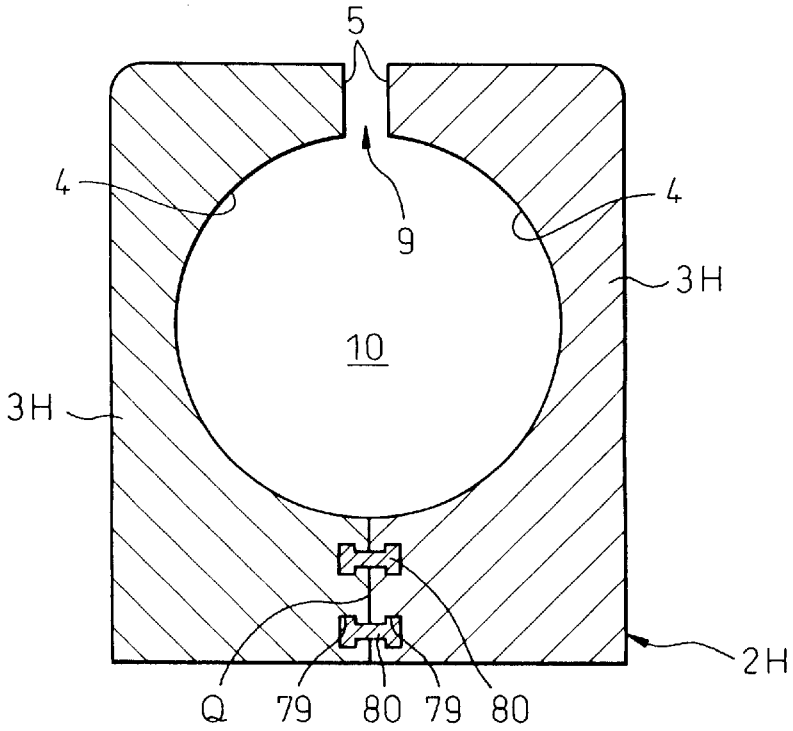

In FIG. 17, the housing 2H is composed of two identical housing members 3H. In this embodiment, a pair of T-shaped grooves 79 are formed on the coupling surface Q of each housing member 3H. In order to form the housing 2H, two housing members 3H are pressed against each other while abutting the coupling surfaces Q thereof so that corresponding pair of T-shaped grooves 79 on both housing members form H-shaped holes. In this condition, H-shaped coupling members 80 are inserted into the H-shaped holes from the longitudinal end face of the housing 2H. The housing members 3H are fastened to each other by the engagement of the H-shaped coupling members 80 and the T-shaped grooves 79 on both housing members.

Figure 18:
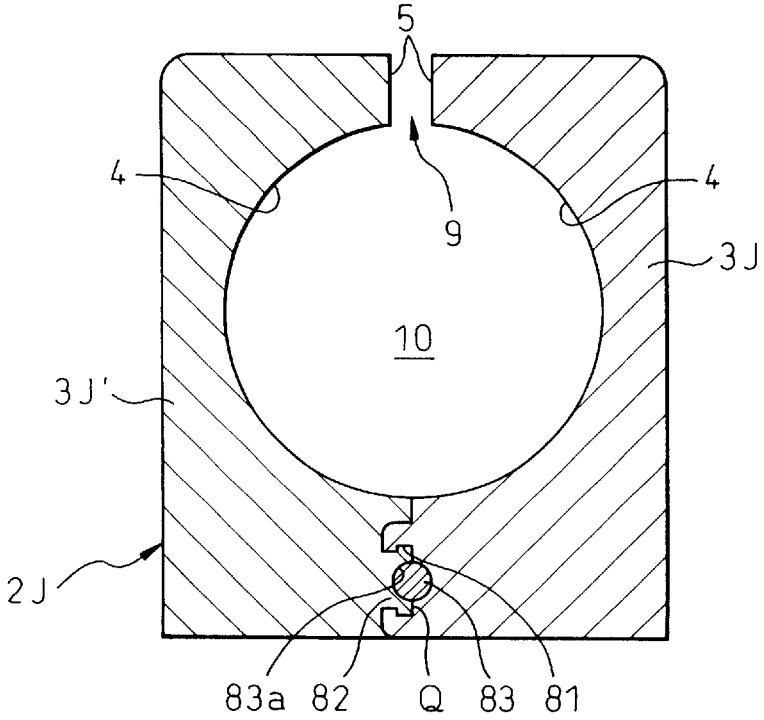
Figure 19:
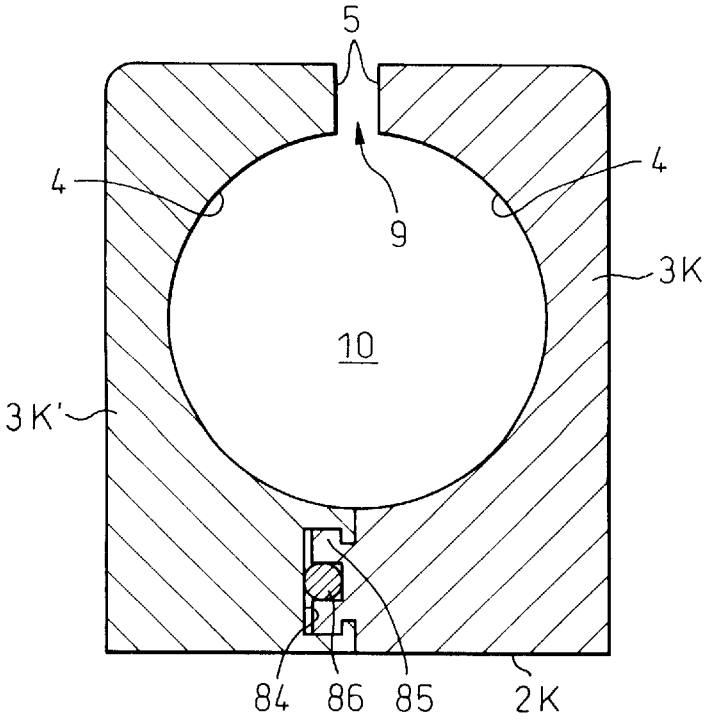

FIGS. 18 and 19 show the case where the housing members are fastened to each other by separate fastening members cooperating with the positioning grooves.

In FIG. 18, the housing members 3J and 3J' of the housing 2J are positioned to each other by the engagement of C-shaped projection 82 formed on the coupling surface Q of the housing member 3J and corresponding grooves 81 on the coupling surface Q of the housing member 3J'. Separate from the projection 82 and grooves 81, a semicircular groove 83*a* is formed on each of the coupling surface Q of the housing members 3J and 3J'. After positioning the housing members 3J and 3*j*' against each other, the semicircular grooves 83*a* on the coupling surfaces Q join each other and form a circular hole. A fastening member 83 in the shape of a circular rod is pressed into the circular hole formed by the grooves 83*a* to secure the engagement between the projection 82 and the grooves 81.

The housing construction in FIG. 19 is similar to that in FIG. 18, except for a T-shaped projection 85 and a groove 84 having a corresponding shape are used in lieu of the C-shaped projection 82 and the grooves 81 in FIG. 18. In this case, the fastening member 86 is pressed into a groove formed in the T-shaped projection 85 in order to secure a firm contact between the T-shaped projection 85 and the groove 84 by expanding the T-shaped projection 85. By using the fastening member 86, the housing members 3K and 3K' are fastened to each other and form a housing 2K.

Figure 20:
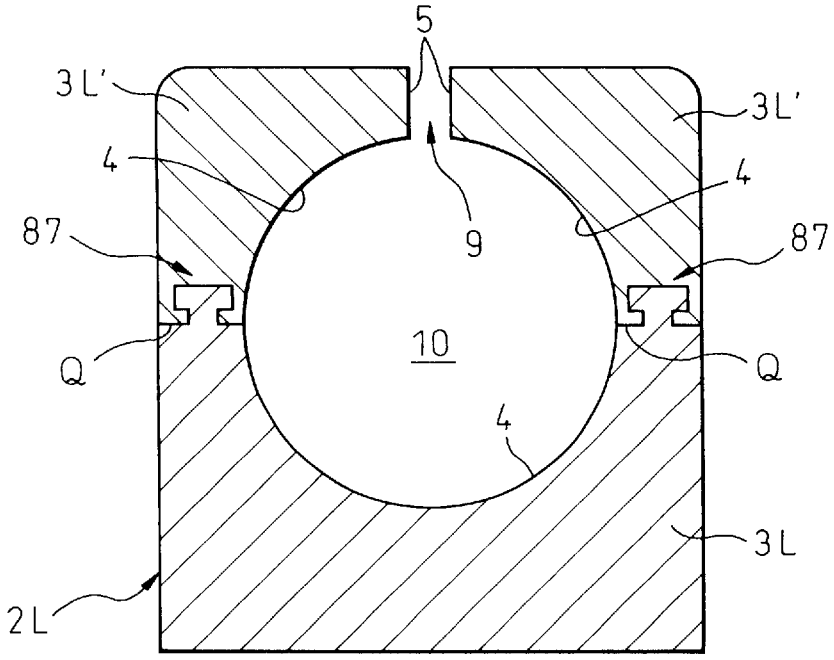

FIG. 20 shows the case where a housing 2L having one slit 9 is formed by three housing members 3L, 3L'.

The upper half of the housing 2L is formed by two identical housing members 3L'. Each of the upper housing members 3L is fastened to the lower housing member 3L by the engagement of the T-shaped projection 87 and corresponding groove in a manner similar to FIG. 16.

Figure 21:
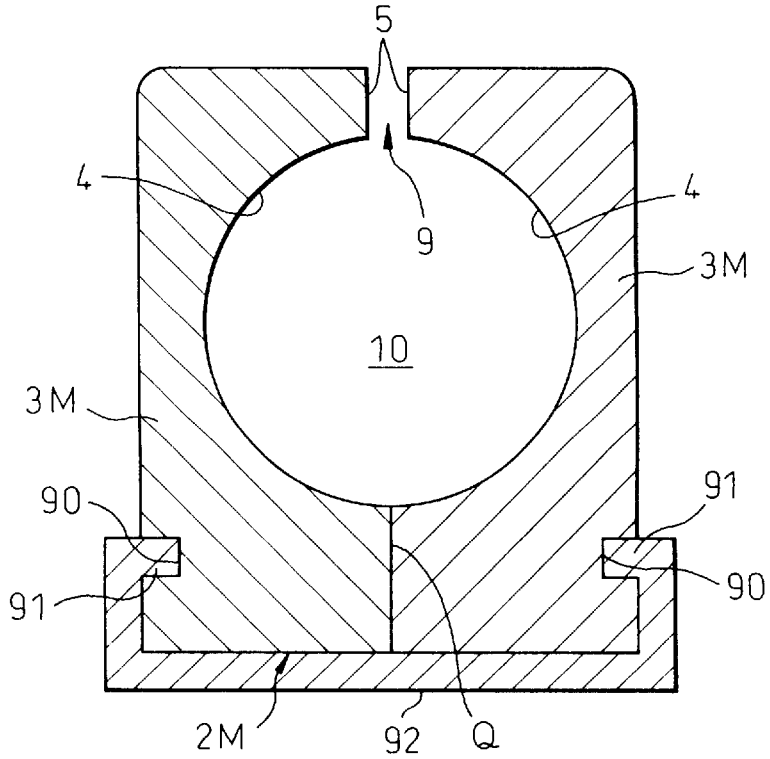

FIG. 21 shows the case where housing members 3M are coupled to each other without using grooves and projections on the coupling surfaces Q. In this case, a housing 2M is formed by clamping the housing members 3M by a clamping member 92. The clamping member 92 has two hook portions 91. By fitting the hook portions 91 into the corresponding grooves 90 formed on the outer surface of the housing members 3M, both housing members 3M are positioned and fastened to each other.

As explained above, according to the present invention, since the housing of the actuator device is formed by coupling a plurality of separate housing members, the cross sectional shapes of the respective housing members are simplified and, thereby, the designing and manufacturing process of the housing are largely simplified. Further, a housing having one cylinder chamber and a plurality of slits communicating with the cylinder chamber can be easily formed by using the separate housing members. Therefore, the allowable values of the bending moment and the axial forces exerting on the external moving body can be increased by increasing the number of the driving members without decreasing the effective cross sectional area of the cylinder chamber.

What is claimed is:

1. An actuator device comprising a housing having a bore extending along a center axis thereof and at least one slit penetrating the wall of the housing and extending in the direction along the center axis, an internal moving body moving within the bore in the direction along the center axis and a driving member connected to the internal moving body and extending to the outside of the housing through the slit in order to transmit the movement of the internal moving body to the outside of the housing, wherein the housing is formed by combining a plurality of housing members which divide the housing along a plane containing center axis.

2. An actuator device as set forth in claim 1, wherein a plurality of slits communicating to the bore are provided on the wall of the housing.

3. An actuator device as set forth in claim 2, wherein each of the housing members comprises an inner ace forming a part of the wall surface of the bore and at least one slit surface facing the slit surface of the adjacent housing member and defining a slit therebetween.

4. An actuator device as set forth in claim 3, further comprising an external moving body disposed outside of the housing and connected to the internal moving body by the respective driving members in such a manner that the external moving body is moved following the movement of the internal moving body, and wherein at least one of the housing members includes a guide rail for guiding the external moving body in the direction along the center axis.

5. An actuator device as set forth in claim 2, further comprising an external moving body disposed outside of the housing and connected to the internal moving body by the respective driving members in such a manner that the external moving body is moved and follows the movement of the internal moving body.

6. An actuator device as set forth in claim 5, wherein the external moving body is formed in a shape surrounding the outer periphery of the housing.

7. An actuator device as set forth in claim 5, wherein a seal band closes the opening of the slit on the wall of the bore, and wherein the internal moving body is moved within the bore by pressurized fluid supplied into the bore.

8. An actuator device as set forth in claim 7, further comprising an anti-deformation means for preventing deformation of the housing due to the pressure of the fluid supplied into the bore without hampering the movement of the external moving body.

9. An actuator device as set forth in claim 8, wherein the anti-deformation means comprises a frame disposed on outside of the housing and movable in the direction along the center axis and wherein said frame includes a portions urging the housing members towards each other against the pressure of the fluid in the bore.

10. An actuator device as set forth in claim 9, wherein a plurality of the frames are disposed on both sides of the external moving body and, wherein the frames move in the direction along the center axis in accordance with the movement of the external moving body.

11. An actuator device as set forth in claim 10, wherein the external moving body and the frames adjacent thereto, the frames adjacent to each other and longitudinal end portions of the housing and the frames adjacent thereto, respectively, are connected by a flexible cord so that the distance between the portions connected by the flexible cord is always maintained at less than the length of the flexible cord.

12. An actuator device as set forth in claim 1, wherein each of the housing members is formed by an extrusion process or a drawing process.

13. An actuator device as set forth in claim 1, wherein the housing members have cross sectional shape identical to each other.

14. An actuator device as set forth in claim 1, further comprising an end member fitted to one of the longitudinal ends of the respective housing members in such a manner that the respective housing members are combined by said end member and form the housing.

15. An actuator device as set forth in claim 1, wherein the bore has a curved center axis.

16. An actuator device as set forth in claim 1, wherein one slit which communicate to the bore is provided on the wall of the housing.

17. An actuator device as set forth in claim 16, wherein each of the housing members comprises an inner surface forming a part of the wall surface of the bore and at least one coupling surface which abuts the coupling surface of an adjacent housing member and wherein two of the housing members disposed adjacent to each other further comprise a slit surface, respectively, and said slit surfaces of the two housing members define a slit on the housing therebetween.

18. An actuator device as set forth in claim 17, further comprising positioning means for determining the relative position of the adjacent housing members joined to each other via the coupling surfaces, wherein said positioning means comprises a projection formed on one of the coupling surface and extending in the direction along the center axis and a groove formed on the other of the coupling surface having a shape fitting the projection.

19. An actuator device as set forth in claim 17, further comprising positioning means for determining the relative position of the adjacent housing members joined each other via the coupling surfaces, wherein said positioning means comprises a positioning hole formed on each of the adjacent pair of the coupling surfaces and a positioning pin fitting both positioning holes on the adjacent pair of the coupling surfaces.

20. An actuator device as set forth in claim 17, further comprising positioning means for determining the relative position of the adjacent housing members joined each other via the coupling surfaces, wherein said positioning means comprises a clamping member which clamps the adjacent pair of the housing members in such a manner that the coupling surfaces of the adjacent pair of the housing members are urged toward each other.

* * * * *